US012565697B2

(12) United States Patent
Matsumoto et al.

(10) Patent No.: US 12,565,697 B2
(45) Date of Patent: Mar. 3, 2026

(54) ELECTRIC RESISTANCE WELDED STEEL PIPE AND METHOD FOR PRODUCING THE SAME

(71) Applicant: JFE Steel Corporation, Tokyo (JP)

(72) Inventors: Akihide Matsumoto, Tokyo (JP); Atsushi Matsumoto, Tokyo (JP); Shinsuke Ide, Tokyo (JP); Takatoshi Okabe, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 677 days.

(21) Appl. No.: 17/913,901

(22) PCT Filed: Mar. 23, 2021

(86) PCT No.: PCT/JP2021/012024
§ 371 (c)(1),
(2) Date: Sep. 23, 2022

(87) PCT Pub. No.: WO2021/200402
PCT Pub. Date: Oct. 7, 2021

(65) Prior Publication Data

US 2024/0229200 A1 Jul. 11, 2024

(30) Foreign Application Priority Data

Apr. 2, 2020 (JP) ..... 2020-066640

(51) Int. Cl.
*C22C 38/04* (2006.01)
*B21C 37/08* (2006.01)
(Continued)

(52) U.S. Cl.
CPC ..... *C22C 38/04* (2013.01); *B21C 37/08* (2013.01); *C21D 6/005* (2013.01); *C21D 8/0226* (2013.01);
(Continued)

(58) Field of Classification Search
None
See application file for complete search history.

(56) References Cited

U.S. PATENT DOCUMENTS

2014/0352852 A1 12/2014 Nakata et al.
2019/0390296 A1 12/2019 Matsumoto et al.

FOREIGN PATENT DOCUMENTS

CN 101171352 A 4/2008
CN 101484602 A 7/2009
(Continued)

OTHER PUBLICATIONS

Office Action issued Sep. 24, 2021, by the Taiwan Patent Office in corresponding Taiwanese Patent Application No. 110111537 and an English translation of the Search Report. (4 pages).
(Continued)

*Primary Examiner* — Anthony M Liang
(74) *Attorney, Agent, or Firm* — Buchanan Ingersoll & Rooney PC

(57) ABSTRACT

An electric resistance welded steel pipe includes a base metal zone and an electric resistance welded zone. The base metal zone has a chemical composition containing, by mass, predetermined amounts of C, Si, Mn, P, S, Al, N, Nb, V, and Ti, with the balance being Fe and incidental impurities. The steel microstructure of the wall-thickness center of the base metal zone includes ferrite and bainite such that the total volume fraction of the ferrite and the bainite in the steel microstructure is 70% or more, with the balance being one or more selected from pearlite, martensite, and austenite. The steel microstructure has an average grain size of 7.0 m or less and a dislocation density of $1.0\times10^{14}$ to $6.0\times10^{15}$ $m^{-2}$. The residual stress generated in the inner and outer surfaces of the pipe in the axial direction is 150 MPa or less.

16 Claims, 1 Drawing Sheet

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/10*** | (2006.01) |
| ***C21D 9/08*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C21D 8/0263* (2013.01); *C21D 8/105* (2013.01); *C21D 9/08* (2013.01); *C22C 38/02* (2013.01); *C22C 38/06* (2013.01); *C22C 38/12* (2013.01); *C22C 38/14* (2013.01); *C21D 2211/002* (2013.01); *C21D 2211/005* (2013.01)

(56) References Cited

FOREIGN PATENT DOCUMENTS

| | | | | |
|---|---|---|---|---|
| CN | 107406940 | A | | 11/2017 |
| CN | 110225987 | A | | 9/2019 |
| CN | 110475894 | A | | 11/2019 |
| EP | 2050833 | A1 | | 4/2009 |
| EP | 3020840 | A1 | | 5/2016 |
| EP | 3085800 | A1 | | 10/2016 |
| EP | 3246427 | A1 | | 11/2017 |
| EP | 3604592 | A1 | | 2/2020 |
| EP | 3608434 | A1 | | 2/2020 |
| JP | 2000178688 | A | | 6/2000 |
| JP | 6052374 | B2 | | 12/2016 |
| JP | 6213702 | B1 | | 9/2017 |
| JP | 6575734 | B1 | * | 9/2019 |
| JP | 6675734 | B1 | | 9/2019 |
| TW | 201829801 | A | | 8/2018 |
| WO | 2013099192 | A1 | | 7/2013 |
| WO | 2015092916 | A1 | | 6/2015 |
| WO | 2017163987 | A1 | | 9/2017 |
| WO | 2020202333 | A1 | | 10/2020 |
| WO | 2021085036 | A1 | | 5/2021 |

OTHER PUBLICATIONS

The Extended European Search Report issued Nov. 24, 2022 by the European Patent Office in corresponding European Patent Applicant No. 21 779 257.1. (8 pages).

The First Office Action issued Jul. 17, 2023, by the State Intellectual Property Office of People's Republic of China in corresponding Chinese Patent Application No. 202180023328.3 and an English translation of the Office Action. (10 pages).

International Search Report and Written Opinion for International Application No. PCT/JP2021/012024, dated Jun. 15, 2021, 6 pages.

Kumagai et al., "Microstructural Features of Cold-Rolled Carbon Steel Evaluated by X-ray Diffraction Line Profile Analysis and Their Correlation with Mechanical Properties", ISIJ International, vol. 54, 2014, No. 1, pp. 206-211.

Ungar et al., "The Effect of Dislocation Contrast on X-ray Line Broadening: A New Approach to Line Profile Analysis", Appl. Phys. Lett., 69(21), Nov. 18, 1996, pp. 3173-3175.

Office Action (Request for the Submission of an Opinion) issued Oct. 12, 2024, by the Korean Intellectual Property Office in corresponding Korean Patent Application No. 10-2022-7033372 and an English translation with Concise Statement of Relevance of the Office Action. (9 pages).

* cited by examiner

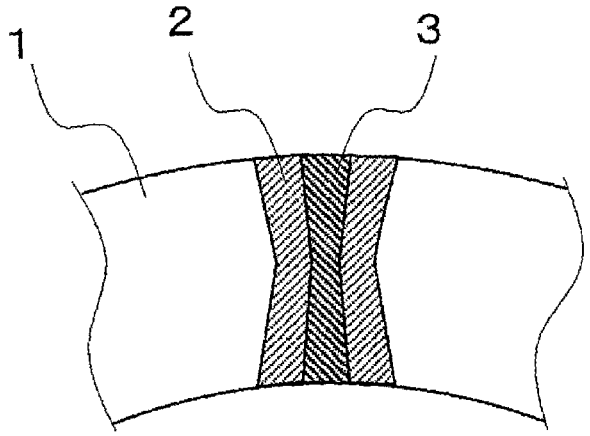
1
2
3

ELECTRIC RESISTANCE WELDED STEEL PIPE AND METHOD FOR PRODUCING THE SAME

CROSS REFERENCE TO RELATED APPLICATIONS

This is the U.S. National Phase application of PCT/JP2021/012024, filed Mar. 23, 2021, which claims priority to Japanese Patent Application No. 2020-066640, filed Apr. 2, 2020, the disclosures of these applications being incorporated herein by reference in their entireties for all purposes.

FIELD OF THE INVENTION

The present invention relates to an electric resistance welded steel pipe and a method for producing the electric resistance welded steel pipe which are suitable for civil and building structures, line pipes, and the like.

BACKGROUND OF THE INVENTION

An electric resistance welded steel pipe is produced by forming a hot rolled steel sheet (steel strip) coiled in a coil form into a hollow-cylindrical open pipe by cold roll forming, while feeding the hot rolled steel sheet in a continuous manner; subsequently performing electric resistance welding, in which both edges of the open pipe which abut to each other in the circumferential direction of the pipe are melted by high-frequency electric resistance heating and pressure-welded to each other by upset with squeeze rolls; and then reducing diameter to a predetermined outside diameter with sizing rolls.

Since electric resistance welded steel pipes are manufactured by cold working in a continuous manner as described above, they are advantageous in terms of, for example, high productivity and high shape accuracy. However, since work hardening occurs in the pipe-making process, electric resistance welded steel pipes are likely to have a higher yield ratio in the longitudinal direction and lower deformability in bending deformation or the like than hot rolled steel sheets, which are materials for electric resistance welded steel pipes.

The larger the wall thickness of an electric resistance welded steel pipe, the higher the degree of work hardening which occurs in the pipe-making process. Therefore, the larger the wall thickness of an electric resistance welded steel pipe, the higher the yield ratio of a thick-walled electric resistance welded steel pipe after pipe-making, and the lower the deformability.

For the above reasons, it has been difficult to apply thick-walled electric resistance welded steel pipes to large structures, such as line pipes and building columns, which are required to have certain buckling resistance in consideration of earthquake resistance and the like.

For example, Patent Literature 1 proposes an electric resistance welded steel pipe for line pipes in which the Nb content is reduced and dislocations introduced in the forming process are pinned by carbon atom clusters, fine carbides, and Nb carbides.

Patent Literature 2 proposes an electric resistance welded steel pipe for line pipes in which the area fraction of the first phase composed of ferrite is 60% to 98% and the balance, that is, the second phase, includes tempered bainite.

The yield ratios of the electric resistance welded steel pipes described in Patent Literatures 1 and 2 are reduced by performing tempering subsequent to pipe-making. However, in particular, in the case where the sheet thickness is 17 mm or more, yield ratio is excessively increased subsequent to pipe-making and, consequently, it becomes impossible to reduce yield ratio to a sufficient degree by tempering. Furthermore, since the above electric resistance welded steel pipes are as-tempered, yield elongation occurs in a tensile test. Therefore, the above electric resistance welded steel pipes are susceptible to local deformation. Thus, they are difficult to be applied to the above-described structures that require certain buckling resistance.

PATENT LITERATURE

PTL 1: Japanese Patent No. 6052374
PTL 2: International Publication No. 2017/163987

Non Patent Literature

NPL 1: T. Ungar and A. Borbely: Appl. Phys. Lett., 69 (1996), 3173.
NPL 2: M. Kumagai, M. Imafuku, S. Ohya: ISIJ International, Vol. 54 (2014) No. 1, p. 206.

SUMMARY OF THE INVENTION

Aspects of the present invention were made in light of the above-described circumstances. An object according to aspects of the present invention is to provide an electric resistance welded steel pipe that has a high strength and is excellent in terms of toughness and buckling resistance and a method for producing the electric resistance welded steel pipe which are suitable for large structures, such as line pipes and building columns.

Note that the expression "high strength" used herein means that a yield stress YS (MPa) measured by a tensile test conducted in accordance with the procedures defined in JIS Z 2241 is 450 MPa or more. The yield stress YS is preferably 460 MPa or more.

The expression "excellent in terms of toughness" used herein means that a Charpy absorbed energy measured at −40° C. in accordance with the procedures defined in JIS Z 2242 is 70 J or more. The Charpy absorbed energy is preferably 150 J or more.

The expression "excellent in terms of buckling resistance" used herein means that the buckling start strain εc (%) of the steel pipe which is measured by an axial compression test satisfies Formula (1).

$$\varepsilon c \geq 40 \times t/D \quad (1)$$

In Formula (1), D represents outside diameter (mm) and t represents wall thickness (mm). The buckling start strain εc (%) is the strain at which the compressive load applied in an axial compression test conducted using a large compressive testing apparatus with a pressure-resistant plate being attached to both ends of the steel pipe reaches its peak.

The inventors of the present invention conducted extensive studies and consequently found that, for producing an electric resistance welded steel pipe having the buckling resistance intended in accordance with aspects of the present invention, it is necessary to limit the yield ratio (=Yield stress/Tensile strength×100) of the electric resistance welded steel pipe in the axial direction to 85% or less and limit the compressive residual stress generated in the inner and outer surfaces of the steel pipe in the axial direction to 150 MPa or less. In other words, lowering the yield ratio to enhance deformability and reducing the compressive residual stress, which promotes compressive deformation, enhances buckling resistance.

It was also found that performing tempering subsequent to the pipe-making of the electric resistance welded steel pipe recovers the dislocations introduced in the pipe-making and reduces both yield ratio and compressive residual stress. However, it was also found that, in the case where the steel pipe is as-tempered, a yield point appears and the reduction in yield ratio is small. In addition, yield elongation occurs. This increases the likelihood of local deformation. As a result, buckling resistance may become degraded conversely.

The inventors further conducted extensive studies and consequently newly found that performing a sizing processing subsequent to tempering while a diameter reduction ratio is adequately controlled and introducing mobile dislocations removes the yield point, markedly lowers yield ratio, and enhances buckling resistance.

Aspects of the present invention were made on the basis of the above-described findings and provide [1] to [6] below.

[1] An electric resistance welded steel pipe including a base metal zone and an electric resistance welded zone, wherein the base metal zone has a chemical composition containing, by mass, C: 0.040% or more and 0.50% or less, Si: 0.02% or more and 2.0% or less, Mn: 0.40% or more and 3.0% or less, P: 0.10% or less, S: 0.050% or less, Al: 0.005% or more and 0.10% or less, N: 0.010% or less, Nb: 0.002% or more and 0.15% or less, V: 0.002% or more and 0.15% or less, Ti: 0.002% or more and 0.15% or less, and Nb+V+Ti: 0.010% or more and 0.20% or less, with the balance being Fe and incidental impurities, wherein a steel microstructure of a wall-thickness center of the base metal zone includes ferrite and bainite such that a total volume fraction of the ferrite and the bainite in the steel microstructure is 70% or more, with the balance being one or two or more selected from pearlite, martensite, and austenite, wherein the steel microstructure has an average grain size of 7.0 μm or less and a dislocation density of $1.0\times10^{14}$ $m^2$ or more and $6.0\times10^{15}$ $m^{-2}$ or less, and wherein a compressive residual stress generated in inner and outer surfaces of the pipe in an axial direction of the pipe is 150 MPa or less.

[2] The electric resistance welded steel pipe described in [1], wherein the chemical composition further contains one or two or more selected from, by mass, Cu: 0.01% or more and 1.0% or less, Ni: 0.01% or more and 1.0% or less, Cr: 0.01% or more and 1.0% or less, Mo: 0.01% or more and 1.0% or less, Ca: 0.0005% or more and 0.010% or less, and B: 0.0003% or more and 0.010% or less.

[3] The electric resistance welded steel pipe described in [1] or [2], wherein a volume fraction of the bainite in the steel microstructure is 90% or more.

[4] The electric resistance welded steel pipe described in any one of [1] to [3], having a wall thickness of 17 mm or more and 30 mm or less.

[5] A method for producing the electric resistance welded steel pipe described in any one of [1] to [4], the method including:

a hot rolling step of heating a steel material to a heating temperature of 1100° C. or more and 1300° C. or less and subsequently performing a hot rolling processing such that a total rolling reduction ratio at 950° C. or less is 60% or more;

a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

According to aspects of the present invention, an electric resistance welded steel pipe that has a high strength and is excellent in terms of toughness and buckling resistance and a method for producing the electric resistance welded steel pipe can be provided.

BRIEF DESCRIPTION OF THE DRAWINGS

The FIGURE is a schematic diagram illustrating a cross section of an electric resistance welded zone of an electric resistance welded steel pipe which is taken in the circumferential direction (cross section perpendicular to the axial direction).

DETAILED DESCRIPTION OF EMBODIMENTS OF THE INVENTION

The base metal zone of the electric resistance welded steel pipe according to aspects of the present invention contains, by mass, C: 0.040% or more and 0.50% or less, Si: 0.02% or more and 2.0% or less, Mn: 0.40% or more and 3.0% or less, P: 0.10% or less, S: 0.050% or less, Al: 0.005% or more and 0.10% or less, N: 0.010% or less, Nb: 0.002% or more and 0.15% or less, V: 0.002% or more and 0.15% or less, Ti: 0.002% or more and 0.15% or less, and Nb+V+Ti: 0.010% or more and 0.20% or less, with the balance being Fe and incidental impurities. The steel microstructure of the wall-thickness center of the base metal zone includes ferrite and bainite such that the total volume fraction of the ferrite and the bainite in the steel microstructure is 70% or more, with the balance being one or two or more selected from pearlite, martensite, and austenite. The above steel microstructure has an average grain size of 7.0 μm or less and a dislocation density of $1.0\times10^{14}$ $m^{-2}$ or more and $6.0\times10^{15}$ $m^{-2}$ or less. The residual stress generated in the inner and outer surfaces of the pipe in the axial direction is 150 MPa or less.

The electric resistance welded steel pipe according to aspects of the present invention and a method for producing the electric resistance welded steel pipe are described below.

The reasons for which the chemical composition of the electric resistance welded steel pipe is limited in accordance with aspects of the present invention are described below. Note that, the symbol "%" used herein for describing a steel composition refers to "% by mass" unless otherwise specified. The chemical composition described below can be taken as the chemical composition of the base metal zone of the electric resistance welded steel pipe.

C: 0.040% or More and 0.50% or Less

C is an element that increases the strength of steel by solid solution strengthening. C is also an element that facilitates the formation of pearlite, enhances hardenability to facilitate the formation of martensite, contributes to stabilization of austenite, and therefore contributes to the formation of hard phases. The C content needs to be 0.040% or more in order to achieve the strength and yield ratio intended in accordance with aspects of the present invention. However, if the C content exceeds 0.50%, the proportion of hard phases is increased and toughness becomes degraded accordingly. In addition, weldability becomes degraded. Accordingly, the C content is limited to 0.040% or more and 0.50% or less. The C content is preferably 0.050% or more and is more preferably 0.06% or more. The C content is preferably 0.30% or less and is more preferably 0.25% or less.

Si: 0.02% or More and 2.0% or Less

Si is an element that increases the strength of steel by solid solution strengthening. In order to produce the advantageous effect, the Si content is 0.02% or more. However, if the Si content exceeds 2.0%, oxides are likely to form in the electric resistance welded zone and, consequently, the properties of the weld zone become degraded. Furthermore, the yield ratio of a portion of the steel pipe which is other than the electric resistance welded zone, that is, the base metal zone, increases and, consequently, toughness becomes degraded. Accordingly, the Si content is limited to 0.02% or more and 2.0% or less. The Si content is preferably 0.03% or more, is more preferably 0.05% or more, and is further preferably 0.10% or more. The Si content is preferably 1.0% or less, is more preferably 0.5% or less, and is further preferably 0.50% or less.

Mn: 0.40% or More and 3.0% or Less

Mn is an element that increases the strength of steel by solid solution strengthening. Mn is also an element that lowers the ferrite transformation start temperature and thereby contributes to refining of microstructure. The Mn content needs to be 0.40% or more in order to achieve the strength and microstructure intended in accordance with aspects of the present invention. However, if the Mn content exceeds 3.0%, oxides are likely to form in the electric resistance welded zone and, consequently, the properties of the weld zone become degraded. Furthermore, as a result of solid solution strengthening and refining of microstructure, yield stress increases. This makes it impossible to achieve the intended yield ratio. Accordingly, the Mn content is limited to 0.40% or more and 3.0% or less. The Mn content is preferably 0.50% or more and is more preferably 0.60% or more. The Mn content is preferably 2.5% or less and is more preferably 2.0% or less.

P: 0.10% or Less

Since P segregates at grain boundaries and degrades the homogeneity of the material, it is preferable to minimize the P content as an incidental impurity. The maximum allowable P content is 0.10%. Accordingly, the P content is limited to 0.10% or less. The P content is preferably 0.050% or less and is more preferably 0.030% or less. Although the lower limit for the P content is not set, the P content is preferably 0.002% or more because reducing the P content to an excessively low level significantly increases the refining costs.

S: 0.050% or Less

S is present in the steel commonly in the form of MnS. MnS is thinly stretched in the hot rolling step and adversely affects ductility. Therefore, in accordance with aspects of the present invention, it is preferable to minimize the S content. The maximum allowable S content is 0.050%. Accordingly, the S content is limited to 0.050% or less. The S content is preferably 0.020% or less and is more preferably 0.010% or less. Although the lower limit for the S content is not set, the S content is preferably 0.0002% or more because reducing the S content to an excessively low level significantly increases the refining costs.

Al: 0.005% or More and 0.10% or Less

Al is an element that serves as a strong deoxidizing agent. In order to produce the above advantageous effect, the Al content needs to be 0.005% or more. However, if the Al content exceeds 0.10%, weldability becomes degraded. Furthermore, the amount of alumina inclusions increases. This degrades surface quality. In addition, the toughness of the weld zone becomes degraded. Accordingly, the Al content is limited to 0.005% or more and 0.10% or less. The Al content is preferably 0.010% or more and is more preferably 0.015% or more. The Al content is preferably 0.080% or less and is more preferably 0.070% or less.

N: 0.010% or Less

N is an incidental impurity and an element that firmly anchors the movement of dislocations and thereby degrades toughness. In accordance with aspects of the present invention, it is desirable to minimize the N content as an impurity. The maximum allowable N content is 0.010%. Accordingly, the N content is limited to 0.010% or less. The N content is preferably 0.0080% or less.

Nb: 0.002% or More and 0.15% or Less

Nb forms fine carbides and nitrides in steel and thereby increases the strength of the steel. Nb is also an element that reduces the likelihood of austenite grains coarsening during hot rolling and thereby contributes to refining of microstructure. In order to produce the above advantageous effects, the Nb content is 0.002% or more. However, if the Nb content exceeds 0.15%, the yield ratio increases and toughness becomes degraded. Accordingly, the Nb content is limited to 0.002% or more and 0.15% or less. The Nb content is preferably 0.005% or more and is more preferably 0.010% or more. The Nb content is preferably 0.13% or less and is more preferably 0.10% or less.

V: 0.002% or More and 0.15% or Less

V is an element that forms fine carbides and nitrides in steel and thereby increases the strength of the steel. In order to produce the above advantageous effects, the V content is 0.002% or more. However, if the V content exceeds 0.15%, the yield ratio increases and toughness becomes degraded. Accordingly, the V content is limited to 0.002% or more and 0.15% or less. The V content is preferably 0.005% or more and is more preferably 0.010% or more. The V content is preferably 0.13% or less and is more preferably 0.10% or less.

Ti: 0.002% or More and 0.15% or Less

Ti is an element that forms fine carbides and nitrides in steel and thereby increases the strength of the steel. Ti is also an element that has a high affinity for N and therefore reduces the content of solute N in steel. In order to produce the above advantageous effects, the Ti content is 0.002% or more. However, if the Ti content exceeds 0.15%, the yield ratio increases and toughness becomes degraded. Accordingly, the Ti content is limited to 0.002% or more and 0.15% or less. The Ti content is preferably 0.005% or more and is more preferably 0.010% or more. The Ti content is preferably 0.13% or less and is more preferably 0.10% or less.

Nb+V+Ti: 0.010% or More and 0.20% or Less

As described above, Nb, V, and Ti are elements that form fine carbides and nitrides in steel and thereby increase the strength of the steel. In order to produce the above advantageous effects, in addition to limiting the Nb, V, and Ti contents to fall within the respective ranges described above, the total content of Nb, V, and Ti, that is, the (Nb+V+Ti) content, is limited to 0.010% or more. However, if the (Nb+V+Ti) content exceeds 0.20%, the yield ratio increases and toughness becomes degraded. Accordingly, the Nb, V, and Ti contents are set such that the (Nb+V+Ti) content is 0.010% or more and 0.20% or less. The (Nb+V+Ti) content is preferably 0.020% or more and is more preferably 0.040% or more. The Nb content is preferably 0.15% or less and is more preferably 0.13% or less.

The balance includes Fe and incidental impurities. The incidental impurities may include O: 0.0050% or less.

The symbol "O" used herein refers to the total oxygen that includes O included in oxides.

The above-described elements are the fundamental constituents of the chemical composition of the electric resistance welded steel pipe according to aspects of the present invention.

The chemical composition may contain one or two or more selected from Cu: 0.01% or more and 1.0% or less, Ni: 0.01% or more and 1.0% or less, Cr: 0.01% or more and 1.0% or less, Mo: 0.01% or more and 1.0% or less, Ca: 0.0005% or more and 0.010% or less, and B: 0.0003% or more and 0.010% or less, as needed.

Cu: 0.01% or More and 1.0% or Less

Cu is an element that increases the strength of steel by solid solution strengthening and may be added to steel as needed. In order to produce the above advantageous effect, in the case where Cu is included, the Cu content is preferably 0.01% or more. However, if the Cu content exceeds 1.0%, toughness and weldability may become degraded. Accordingly, in the case where Cu is included, the Cu content is preferably 0.01% or more and 1.0% or less. The Cu content is more preferably 0.05% or more and is further preferably 0.10% or more. The Cu content is more preferably 0.70% or less and is further preferably 0.50% or less.

Ni: 0.01% or More and 1.0% or Less

Ni is an element that increases the strength of steel by solid solution strengthening and may be added to steel as needed. In order to produce the above advantageous effect, in the case where Ni is included, the Ni content is preferably 0.01% or more. However, if the Ni content exceeds 1.0%, toughness and weldability may become degraded. Accordingly, in the case where Ni is included, the Ni content is preferably 0.01% or more and 1.0% or less. The Ni content is more preferably 0.10% or more. The Ni content is more preferably 0.70% or less and is further preferably 0.50% or less.

Cr: 0.01% or More and 1.0% or Less

Cr is an element that enhances the hardenability of steel and increases the strength of the steel. The steel pipe may include Cr as needed. In order to produce the above advantageous effect, in the case where Cr is included, the Cr content is preferably 0.01% or more. However, if the Cr content exceeds 1.0%, toughness and weldability may become degraded. Therefore, in the case where Cr is included, the Cr content is preferably 1.0% or less. Accordingly, in the case where Cr is included, the Cr content is preferably 0.01% or more and 1.0% or less. The Cr content is more preferably 0.05% or more and is further preferably 0.10% or more. The Cr content is more preferably 0.70% or less and is further preferably 0.50% or less.

Mo: 0.01% or More and 1.0% or Less

Mo is an element that enhances the hardenability of steel and increases the strength of the steel. The steel pipe may include Mo as needed. In order to produce the above advantageous effect, in the case where Mo is included, the Mo content is preferably 0.01% or more. However, if the Mo content exceeds 1.0%, toughness and weldability may become degraded. Therefore, in the case where Mo is included, the Mo content is preferably 1.0% or less. Accordingly, in the case where Mo is included, the Mo content is preferably 0.01% or more and 1.0% or less. The Mo content is more preferably 0.05% or more and is further preferably 0.10% or more. The Mo content is more preferably 0.70% or less and is further preferably 0.50% or less.

Ca: 0.0005% or More and 0.010% or Less

Ca is an element that enhances the toughness of the steel by increasing the sphericity of sulfide grains, such as MnS, which are thinly stretched in the hot rolling step and may be added to the steel pipe as needed. In the case where Ca is included, the Ca content is preferably 0.0005% or more in order to produce the above advantageous effect. However, if the Ca content exceeds 0.010%, Ca oxide clusters are formed in steel and, consequently, toughness becomes degraded. Accordingly, in the case where Ca is included, the Ca content is preferably 0.0005% or more and 0.010% or less. The Ca content is more preferably 0.0008% or more and is further preferably 0.0010% or more. The Ca content is more preferably 0.008% or less and is further preferably 0.0060% or less.

B: 0.0003% or More and 0.010% or Less

B is an element that contributes to refining of microstructure by lowering the ferrite transformation start temperature and may be added to the steel pipe as needed. In the case where B is included, the B content is preferably 0.0003% or more in order to produce the above advantageous effects. However, if the B content exceeds 0.010%, the yield ratio is increased and toughness becomes degraded. Accordingly, in the case where B is included, the B content is preferably 0.0003% or more and 0.010% or less. The B content is more preferably 0.0005% or more and is further preferably 0.0008% or more. The B content is more preferably 0.0050% or less, is further preferably 0.0030% or less, and is further more preferably 0.0020% or less.

The reasons for the limitations on the steel microstructure of the electric resistance welded steel pipe according to aspects of the present invention are described below.

The steel microstructure of the wall-thickness center of the base metal zone of the electric resistance welded steel pipe according to aspects of the present invention has an average grain size of 7.0 μm or less and a dislocation density of $1.0\times10^{14}$ $m^{-2}$ or more and $6.0\times10^{15}$ $m^{-2}$ or less.

The term "average grain size" used herein refers to the average equivalent circle diameter of the crystal grains (grain boundaries) defined as regions surrounded by boundaries between adjacent crystals having a misorientation of 15° or more. The term "equivalent circle diameter (grain size)" used herein refers to the diameter of a circle having the same area as the crystal grain that is to be measured.

Average Grain Size: 7.0 μm or Less

If the average grain size exceeds 7.0 μm, the microstructure is not refined to a sufficient degree and, consequently, the intended toughness cannot be achieved. Therefore, in accordance with aspects of the present invention, the average grain size is limited to 7.0 μm or less. The average grain size is preferably 6.0 μm or less.

Dislocation Density: $1.0\times10^{14}$ $m^{-2}$ or More and $6.0\times10^{15}$ $m^{-2}$ or Less If the dislocation density is less than $1.0\times10^{4}$ $m^{-2}$, the amount of cold sizing processing performed subsequent to tempering is small and, consequently, the yield point cannot be removed to a sufficient degree. This increases the occurrence of local deformation and degrades buckling resistance. If the dislocation density exceeds $6.0\times10^{15}$ $m^{-2}$, dislocations cannot be recovered by tempering to a sufficient degree. In another case, the amount of cold sizing processing performed subsequent to tempering becomes excessively large. This increases the yield ratio and degrades deformation performance and buckling resistance. Furthermore, toughness becomes degraded.

Accordingly, in accordance with aspects of the present invention, the dislocation density is limited to $1.0\times10^{14}$ $m^{-2}$ or more and $6.0\times10^{15}$ $m^{-2}$ or less. The dislocation density is preferably $3.0\times10^{14}$ $m^{-2}$ or more. The dislocation density is preferably $2.0\times10^{15}$ $m^{-2}$ or less.

Dislocation density can be determined by electropolishing a cross section of the pipe which is perpendicular to the longitudinal direction to a depth of 100 μm, subsequently performing X-ray diffractometry at the center of the steel sheet in the thickness direction, and performing a calculation on the basis of the results using the modified Williamson-Hall method or the modified Warren-Averbach method (Non-Patent Literatures 1 and 2). CuKα radiation is used as an X-ray source. The tube voltage is set to 45 kV. The tube current is set to 200 mA. The Burgers vector b can be $0.248\times10^{-9}$ m, which is the interatomic distance in the slip direction of bcc iron, <111>.

Furthermore, the above steel microstructure includes ferrite and bainite such that the total volume fraction of ferrite and bainite in the steel microstructure is 70% or more, with the balance being one or two or more selected from pearlite, martensite, and austenite.

Total Volume Fraction of Ferrite and Bainite: 70% or More

Ferrite is a soft microstructure. Bainite is a microstructure that is harder than ferrite, that is softer than pearlite, martensite, and austenite, and that is excellent in terms of toughness. Mixing ferrite and bainite with a hard microstructure reduces yield ratio and enhances deformation performance. However, in such a case, stress concentration occurs due to the difference in hardness and fracture is likely to occur at the interfaces. This degrades toughness. Accordingly, the total volume fraction of ferrite and bainite is limited to 70% or more and is preferably 80% or more. It is more preferable that the volume fraction of bainite be 90% or more.

The nucleation sites of the above microstructures except austenite are austenite grain boundaries or deformation bands inside austenite grains. Increasing the amount of rolling reduction performed at low temperatures, at which the occurrence of recrystallization of austenite is small, during hot rolling enables a large amount of dislocations to be introduced to austenite to refine austenite and enables a large amount of deformation bands into the grains. This increases the area of nucleation sites and the frequency of nucleation and thereby enables the steel microstructure to be refined.

In accordance with aspects of the present invention, the above-described advantageous effects can be produced even in the case where the above steel microstructure is present in the ranges ±1.0 mm from the sheet-thickness center in the sheet-thickness direction. Therefore, the expression "steel microstructure at sheet-thickness center" used herein means that the above-described steel microstructure is present in either of the ranges ±1.0 mm from the sheet-thickness center in the sheet-thickness direction.

In the observation of steel microstructure, first, a test specimen for microstructure observation is prepared by taking a sample such that the observation surface is a cross section of the pipe which is perpendicular to the longitudinal direction of the pipe and is at the sheet-thickness center, polishing the sample, and subsequently performing nital etching. In the microstructure observation, a microstructure present at the sheet-thickness center is observed and an image of the microstructure is taken with an optical microscope (magnification: 1000 times) or a scanning electron microscope (SEM, magnification: 1000 times). The area fractions of bainite and the balance (ferrite, pearlite, martensite, and austenite) are determined on the basis of the optical microscope image and the SEM image. The area fractions of the above microstructure components are each determined by conducting the above observation in five or more fields of view and taking the average of the fractions measured. The area fractions determined by the microstructure observation are considered as the volume fractions of the microstructure components.

Ferrite is the product of diffusion transformation and appears as a nearly recovered microstructure having a low dislocation density. Examples of such ferrite include polygonal ferrite and quasipolygonal ferrite.

Bainite is a multi-phase microstructure including lath ferrite having a high dislocation density and cementite.

Pearlite is a eutectic microstructure (ferrite+cementite) including iron and iron carbide and appears as a lamellar microstructure including linear ferrite and cementite arranged alternately.

Martensite is a lath, low-temperature transformation microstructure having a markedly high dislocation density and appears lighter than ferrite and bainite in a SEM image.

In an optical microscope image and a SEM image, it is difficult to distinguish martensite and austenite from each other. Therefore, the volume fraction of martensite is determined by calculating the area fraction of microstructure identified as martensite or austenite in the SEM image and subtracting the volume fraction of austenite measured by the method described below from the above fraction.

The volume fraction of austenite is measured by X-ray diffraction. A test specimen for microstructure observation is prepared by performing grinding such that a diffraction plane is at the sheet-thickness center and removing a surface processing layer by chemical polishing. In the measurement, Mo-Kα radiation is used. The volume fraction of austenite is calculated on the basis of the integral intensities of the (200), (220), and (311) planes of fcc iron and the (200) and (211) planes of bcc iron.

In the measurement of the above average grain size, first, a grain size distribution histogram (graph with the horizontal axis representing grain size and the vertical axis representing the abundance at the grain size) is calculated using a SEM/EBSD method. Then, the arithmetic average grain size is calculated and used as an average grain size.

The measurement is conducted under the following conditions: acceleration voltage: 15 kV, measurement region: 500 μm×500 μm, measurement step size (measurement resolution): 0.5 μm. In the grain size analysis, crystal grains having a size of 2.0 μm or less are considered as a measurement noise and excluded from analysis targets.

Compressive Residual Stress Generated in Inner and Outer Surfaces of Pipe in Axial Direction: 150 MPa or Less The reasons for the limitations on the compressive residual stress of the electric resistance welded steel pipe according to aspects of the present invention are described below.

The compressive residual stress generated in the inner and outer surfaces of the electric resistance welded steel pipe according to aspects of the present invention in the axial direction is 150 MPa or less.

If the compressive residual stress of the steel pipe exceeds 150 MPa, the stiffness of the steel pipe against compressive deformation in the axial direction or the compressive deformation of an inner portion of a bend during bending deformation becomes degraded and, consequently, buckling may occur easily. Accordingly, the compressive residual stress generated in the inner and outer surfaces of the steel pipe in the axial direction is limited to 150 MPa or less and is more preferably 100 MPa or less.

The measurement of residual stress is conducted, by X-ray diffraction, in the planes exposed by electropolishing the inner and outer surfaces of the electric resistance welded steel pipe at the longitudinal center of the pipe to a depth of 100 μm. CrKα radiation is used as an X-ray source. The tube voltage is set to 30 kV. The tube current is set to 1.0 mA. The measurement is conducted using a cos α method. The lattice plane that is to be measured is (211).

The residual stress is determined in the axial direction of the pipe. The measurement is conducted at the inner and outer surfaces of the electric resistance welded zone and positions (12 positions) spaced at intervals of 30 degrees with reference to the electric resistance welded zone in the circumferential direction of the pipe, that is, at 24 positions for each electric resistance welded steel pipe. The maximum compressive residual stress is determined on the basis of the results of measurement at the 24 positions. This maximum value is considered as a compressive residual stress in accordance with aspects of the present invention.

A method for producing the electric resistance welded steel pipe according to an embodiment of the present invention is described below.

A method for producing the electric resistance welded steel pipe according to aspects of the present invention includes, for example, heating a steel material having the above-described chemical composition to a heating temperature of 1100° C. or more and 1300° C. or less and subsequently performing a hot rolling processing such that the total rolling reduction ratio at 950° C. or less is 60% or more (hot rolling step); subsequently performing cooling at an average cooling rate of 10° C./s or more and 40° C./s or less and a cooling stop temperature of 400° C. or more and 650° C. or less, in terms of the temperature of the sheet-thickness center (cooling step); subsequently performing coiling at 400° C. or more and 650° C. or less to prepare a hot rolled steel sheet (coiling step); then forming the hot rolled steel sheet into a hollow-cylindrical shape by cold roll forming and subsequently performing electric resistance welding to prepare a steel pipe material (pipe-making step); subsequently heating the steel pipe material at 500° C. or more and 700° C. or less for 10 s or more and 1000 s or less (tempering step); and then, in a sizing step, reducing diameter such that the circumference of the steel pipe material reduces by 0.50% or more and 4.0% or less to form an electric resistance welded steel pipe.

In the description of the manufacturing method below, when referring to temperature, the symbol "° C." refers to the surface temperature of the steel material, steel sheet (hot rolled steel sheet), or steel pipe material, unless otherwise specified. These surface temperatures can be measured with a radiation thermometer or the like. The temperature of the center of the steel sheet in the thickness direction can be determined by calculating the temperature distribution in a cross section of the steel sheet by heat-transfer analysis and correcting the results on the basis of the surface temperature of the steel sheet. The term "hot rolled steel sheet" used herein refers to not only hot rolled steel sheet but also hot rolled steel strip.

In accordance with aspects of the present invention, a method for preparing a steel material (steel slab) is not limited and any of known molten steel-preparing methods using a converter, an electric furnace, a vacuum melting furnace, or the like may be used. The casting method is not limited, either. A steel slab having intended dimensions can be produced by a known casting method, such as continuous casting. Note that an ingot casting-slabbing process may be used instead of continuous casting with no problem. The molten steel may be further subjected to secondary refining, such as ladle refining.

The resulting steel material (steel slab) is heated to a heating temperature of 1100° C. or more and 1300° C. or less and subsequently subjected to a hot rolling processing such that the total rolling reduction ratio at 950° C. or less is 60% or more (hot rolling step).

Hot Rolling Step

Heating Temperature: 1100° C. or More and 1300° C. or Less

If the heating temperature is less than 1100° C., the deformation resistance of the steel material that is to be rolled is increased and, consequently, it becomes difficult to perform rolling. On the other hand, if the heating temperature exceeds 1300° C., austenite grains become coarsened and fine austenite grains cannot be formed in the subsequent rolling step (rough rolling and finish rolling). In such a case, it becomes difficult to achieve the average grain size of the steel microstructure of the electric resistance welded steel pipe which is intended in accordance with aspects of the present invention. Accordingly, the heating temperature in the hot rolling step is limited to 1100° C. or more and 1300° C. or less. The heating temperature is more preferably 1120° C. or more. The heating temperature is more preferably 1280° C. or less.

In accordance with aspects of the present invention, in addition to a conventional method in which, subsequent to the production of a steel slab (slab), the slab is temporarily cooled to room temperature and then reheated, energy-saving hot-charge rolling processes in which a hot slab is directly charged into a heating furnace without being cooled to room temperature or in which heat insulation is performed for a short period of time and rolling is then performed immediately may also be used with no problem.

The rough rolling delivery temperature is preferably 850° C. or more and 1150° C. or less. If the rough rolling delivery temperature is less than 850° C., the surface temperature of the steel sheet may be reduced to a temperature equal to or less than the ferrite transformation start temperature in the subsequent finish rolling step. In such a case, a large amount of deformed ferrite is formed, which increases the yield ratio.

As a result, it becomes impossible to recover dislocations to a sufficient degree even when tempering is performed subsequent to pipe-making, and the yield ratio remains high.

On the other hand, if the rough rolling delivery temperature exceeds 1150° C., a sufficient amount of rolling reduction cannot be done within the austenite non-recrystallization temperature range. This makes it impossible to form fine austenite grains and, consequently, it becomes difficult to achieve the average grain size of the steel microstructure of the electric resistance welded steel pipe which is intended in accordance with aspects of the present invention. As a result, toughness becomes degraded. The rough rolling delivery temperature is more preferably 860° C. or more. The rough rolling delivery temperature is more preferably 1000° C. or less.

Total Rolling Reduction Ratio at 950° C. or Less: 60% or More

In accordance with aspects of the present invention, the subgrains of austenite are refined in the hot rolling step in order to refine ferrite, bainite, and the remaining microstructure formed in the subsequent cooling and coiling steps and thereby form the steel microstructure of the electric resistance welded steel pipe having the strength and toughness intended in accordance with aspects of the present invention. For refining the subgrains of austenite in the hot rolling step, it is necessary to increase the rolling reduction ratio in the austenite non-recrystallization temperature range and thereby introduce a sufficiently large working strain. In order to achieve this, in accordance with aspects of the present invention, the total rolling reduction ratio at 950° C. or less is limited to 60% or more.

If the total rolling reduction ratio at 950° C. or less is less than 60%, a sufficiently large working strain cannot be introduced in the hot rolling step. In such a case, a microstructure having the average grain size intended in accordance with aspects of the present invention cannot be formed. The total rolling reduction ratio at 950° C. or less is more preferably 65% or more. Although the upper limit for the above total rolling reduction ratio is not set, if the above total rolling reduction ratio is more than 80%, the effectiveness of increasing the rolling reduction ratio to enhance toughness is reduced and only the machine load is increased accordingly. Therefore, the total rolling reduction ratio at 950° C. or less is preferably 80% or less and is more preferably 75% or less.

Note that the total rolling reduction ratio at 950° C. or less is the total of the rolling reduction ratios of rolling passes within a temperature range of 950° C. or less.

The finish rolling start temperature is preferably 800° C. or more and 950° C. or less. If the finish rolling start temperature is less than 800° C., the surface temperature of the steel sheet may be reduced to a temperature equal to or less than the ferrite transformation start temperature in the finish rolling step. In such a case, a large amount of deformed ferrite is formed, which increases the yield ratio. As a result, it becomes impossible to recover dislocations to a sufficient degree even when tempering is performed subsequent to pipe-making, and the yield ratio remains high. On the other hand, if the finish rolling start temperature exceeds 950° C., coarsening of austenite grains occurs and a sufficient amount of deformation bands are not introduced to austenite. Consequently, it becomes impossible to achieve the average grain size of the steel microstructure which is intended in accordance with aspects of the present invention. As a result, it becomes difficult to achieve the average grain size of the steel microstructure of the electric resistance welded steel pipe which is intended in accordance with aspects of the present invention and toughness becomes degraded. The finish rolling start temperature is more preferably 820° C. or more. The finish rolling start temperature is more preferably 930° C. or less.

The finish rolling delivery temperature is preferably 750° C. or more and 850° C. or less. If the finish rolling delivery temperature is less than 750° C., the surface temperature of the steel sheet may be reduced to a temperature equal to or less than the ferrite transformation start temperature in the finish rolling step. In such a case, a large amount of deformed ferrite is formed, which increases the yield ratio. As a result, it becomes impossible to recover dislocations to a sufficient degree even when tempering is performed subsequent to pipe-making, and the yield ratio remains high. On the other hand, if the finish rolling delivery temperature exceeds 850° C., a sufficient amount of rolling reduction cannot be done within the austenite non-recrystallization temperature range. This makes it impossible to form fine austenite grains and, consequently, it becomes difficult to achieve the average grain size of the steel microstructure of the electric resistance welded steel pipe which is intended in accordance with aspects of the present invention. Consequently, it becomes difficult to achieve the average grain size of the steel microstructure of the electric resistance welded steel pipe which is intended in accordance with aspects of the present invention and toughness becomes degraded. The finish rolling delivery temperature is more preferably 770° C. or more. The finish rolling delivery temperature is more preferably 830° C. or less.

Cooling Step

Subsequent to the hot rolling step, in the cooling step, the hot rolled steel sheet is subjected to a cooling treatment.

In the cooling step, cooling is performed such that the average cooling rate at which the temperature is reduced to the cooling stop temperature is 10° C./s or more and 40° C./s or less and the cooling stop temperature is 400° C. or more and 650° C. or less.

Average Cooling Rate from when Cooling is Started to when Cooling is Stopped (Cooling is Finished): 10° C./s or More and 40° C./s or Less If the average cooling rate at which cooling is performed from when the cooling is started to when cooling is stopped, which is described below, is less than 10° C./s in terms of the temperature of the center of the hot rolled steel sheet in the thickness direction, the nucleation frequency of ferrite or bainite is reduced and ferrite or bainite grains become coarsened. In such a case, it becomes impossible to form a microstructure having the average grain size intended in accordance with aspects of the present invention. On the other hand, if the average cooling rate exceeds 40° C./s, a large amount of martensite is formed and toughness becomes degraded. The average cooling rate is preferably 15° C./s or more. The average cooling rate is preferably 35° C./s or less.

In accordance with aspects of the present invention, it is preferable to start cooling immediately after the finish rolling has been finished, in order to suppress the formation of ferrite in the surface of the steel sheet that is to be cooled.

Cooling Stop Temperature: 400° C. or More and 650° C. or Less

If the cooling stop temperature at which the cooling is stopped is less than 400° C. in terms of the temperature of the center of the hot rolled steel sheet in the thickness direction, a large amount of martensite is formed and toughness becomes degraded. On the other hand, if the cooling stop temperature is more than 650° C., the nucleation frequency of ferrite or bainite is reduced and ferrite or bainite grains become coarsened. In such a case, it becomes impossible to form a microstructure having the average grain size intended in accordance with aspects of the present invention. The cooling stop temperature is preferably 430° C. or more. The cooling stop temperature is preferably 620° C. or less.

Note that, in accordance with aspects of the present invention, the average cooling rate is the value (cooling rate) calculated by ((Temperature of center of hot rolled steel sheet in thickness direction before cooling—Temperature of center of hot rolled steel sheet in thickness direction after cooling)/The amount of time during which cooling is performed) unless otherwise specified. Examples of the cooling method include a water cooling method in which, for example, water is sprayed from a nozzle and a cooling method in which a coolant gas is sprayed. In accordance with aspects of the present invention, it is preferable to subject both surfaces of the hot rolled steel sheet to a cooling operation (treatment) such that both surfaces of the hot rolled steel sheet are cooled under the same conditions.

Coiling Step

Subsequent to the cooling step, in the coiling step, the hot rolled steel sheet is coiled in a coil form and then allowed to be naturally cooled.

In the coiling step, the hot rolled steel sheet is preferably coiled at a coiling temperature of 400° C. or more and 650° C. or less in consideration of the microstructure of the steel sheet. If the coiling temperature is less than 450° C. less, a large amount of martensite is formed and toughness becomes degraded. If the coiling temperature exceeds 650° C. more, the nucleation frequency of ferrite or bainite is reduced and ferrite or bainite grains become coarsened. In such a case, it becomes impossible to form a microstructure having the average grain size intended in accordance with aspects of the present invention. The coiling temperature is preferably 430° C. or more. The coiling temperature is preferably 620° C. or less.

Pipe-Making Step

Subsequent to the coiling step, in a pipe-making step, a pipe-making processing is performed. In the pipe-making step, while the hot rolled steel sheet is fed in a continuous manner, it is formed into a hollow-cylindrical open pipe (round steel pipe) by cold roll forming and electric resistance welding, in which both edges of the open pipe which abut to each other in the circumferential direction of the pipe are melted by high-frequency electric resistance heating and pressure-welded to each other by upset with squeeze rolls, is performed to form a steel pipe material. Optionally, a sizing processing may be performed subsequently. In the sizing processing, the diameter of the electric resistance welded steel pipe is reduced with rolls arranged to face the upper, lower, left, and right sides of the electric resistance welded steel pipe in order to adjust the outside diameter and roundness of the steel pipe to be the intended values.

The amount of upset with which the electric resistance welding is performed is preferably 20% or more of the thickness of the steel sheet in order to enable the inclusions that degrade toughness, such as oxides and nitrides, to be discharged together with molten steel. However, if the amount of upset exceeds 100% of the thickness of the steel sheet, the load applied to the squeeze rolls is increased. Accordingly, the amount of upset is preferably 20% or more and 100% or less and is more preferably 40% or more of the thickness of the steel sheet. The amount of upset is more preferably 80% or less of the thickness of the steel sheet.

In the sizing step subsequent to electric resistance welding, it is preferable to perform in order to facilitate, for example, the transportation of the steel pipe. In order to enhance the accuracy of outside diameter and roundness, it is preferable to reduce the diameter of the steel pipe such that the circumference of the steel pipe is reduced by 0.5% or more in total. If the diameter reduction is performed such that the circumference of the steel pipe is reduced by more than 4.0% in total, the amount the steel pipe is bent in the axial direction when the steel pipe passes through the rolls is increased and, accordingly, yield ratio and compressive residual stress increase. As a result, it becomes impossible to recover dislocations to a sufficient degree even when tempering is performed subsequent to pipe-making, and the yield ratio and compressive residual stress remain high. Therefore, it is preferable to perform the diameter reduction such that the circumference of the steel pipe is reduced by 0.5% or more and 4.0% or less. The above reduction is more preferably 1.0% or more. The above reduction is more preferably 3.0% or less.

In the sizing step subsequent to the electric resistance welding, it is preferable to perform the diameter reduction in multiple stages with a plurality of stands in order to minimize the amount the steel pipe is bent in the axial direction while being passed through the rolls and limit the generation of the residual stress in the axial direction of the steel pipe. It is preferable that the reduction in the circumference of the steel pipe which is achieved with each stand in the diameter reduction step be 1.0% or less.

Tempering Step

In the subsequent tempering step, the steel pipe material is subjected to a tempering treatment. In the tempering step, the electric resistance welded steel pipe is heated at 500° C. or more and 700° C. or less for 10 s or more and 1000 s or less.

For performing the heating, either furnace heating or induction heating may be used.

If the heating temperature is less than 500° C., the dislocations are not recovered to a sufficient degree, and the yield ratio and compressive residual stress increase accordingly. As a result, the buckling resistance intended in accordance with aspects of the present invention cannot be achieved. If the heating temperature exceeds 700° C., the hard second phase is formed, which degrades toughness. Therefore, the heating temperature is limited to 500° C. or more and 700° C. or less.

If the heating time is less than 10 s, the dislocations are not recovered to a sufficient degree, and the yield ratio and compressive residual stress are increased accordingly. If the heating time exceeds 1000 s, the effect of reducing yield ratio and residual stress becomes saturated and the heating costs increase. This only reduces the productivity. Therefore, the heating time is limited to 10 s or more and 1000 s or less.

For performing cooling subsequent to the heating, either water cooling or natural cooling may be used.

The temperature at which the cooling subsequent to the heating is stopped is preferably 200° C. or less. If the temperature at which the cooling subsequent to the heating is stopped exceeds 200° C., a sufficient amount of mobile dislocations cannot be introduced in the subsequent sizing step and, consequently, yield point and yield elongation remain. This makes it impossible to achieve the yield ratio and buckling resistance intended in accordance with aspects of the present invention. Although the lower limit for the temperature at which the cooling subsequent to the heating is stopped is not set, this temperature is preferably equal to or higher than room temperature in consideration of cooling costs.

Sizing Step

Subsequent to the tempering step, in the sizing step, diameter reduction is performed such that the circumference of the steel pipe is reduced by 0.50% or more and 4.0% or less.

If the above circumference reduction is less than 0.50%, a sufficient amount of mobile dislocations cannot be introduced and, consequently, yield point and yield elongation remain. This makes it impossible to achieve the yield ratio and buckling resistance intended in accordance with aspects of the present invention. If the above circumference reduction exceeds 4.0%, the amount of work hardening increases. Consequently, yield ratio increases and deformation performance becomes degraded. This results in the degradation of buckling resistance and toughness. Therefore, in the sizing step subsequent to tempering, diameter reduction is performed such that the circumference of the steel pipe is reduced by 0.50% or more and 4.0% or less. The above circumference reduction is preferably 1.0% or more and 3.0% or less.

In the sizing step subsequent to the tempering, it is preferable to perform the diameter reduction in multiple stages with a plurality of stands in order to minimize the amount the steel pipe is bent in the axial direction while being passed through the rolls and limit the generation of the residual stress in the axial direction of the steel pipe. It is preferable that the reduction in the circumference of the steel pipe which is achieved with each stand in the diameter reduction step be 1.0% or less.

Whether or not the steel pipe is an electric resistance welded steel pipe can be determined by cutting the electric resistance welded steel pipe in a direction perpendicular to the axial direction of the steel pipe, polishing a cross section of the steel pipe which includes a weld zone (electric resistance welded zone), etching the cross section with an etchant, and then inspecting the cross section with an optical microscope. The steel pipe is considered as an electric resistance welded steel pipe when the width of a molten and solidified zone of the weld zone (electric resistance welded zone) in the circumferential direction of the steel pipe is 1.0 μm or more and 1000 μm or less all over the entire thickness of the steel pipe.

The etchant used above may be selected appropriately in accordance with the constituents of the steel and the type of the steel pipe. In the FIGURE, the molten and solidified zone can be visually identified as a region 3 having a microstructure and a contrast different from those of a base metal zone 1 or heat affected zone 2, as illustrated in the schematic diagram of the etched cross section of the FIGURE. For example, a molten and solidified zone of an electric resistance welded steel pipe composed of a carbon steel and a low-alloy steel can be identified as a region that appears white in the above nital-etched cross section when observed with an optical microscope, and a molten and solidified zone of a UOE steel line pipe composed of a carbon steel and a low-alloy steel can be identified as a region that includes a cell-like or dendrite solidified microstructure in the above nital-etched cross section when observed with an optical microscope.

The electric resistance welded steel pipe according to aspects of the present invention is produced by the above-described method. The electric resistance welded steel pipe according to aspects of the present invention has excellent buckling resistance even in the case where, in particular, the steel pipe has a thick wall having a thickness of 17 mm or more. The electric resistance welded steel pipe according to aspects of the present invention further has excellent toughness.

The yield stress YS of the electric resistance welded steel pipe according to aspects of the present invention which is measured by a tensile test in accordance with the procedures defined in JIS Z 2241 is 450 MPa or more and is preferably 460 MPa or more. If the yield stress is excessively high, yield ratio is increased and toughness becomes degraded. Therefore, the yield stress YS of the electric resistance welded steel pipe according to aspects of the present invention is preferably 650 MPa or less and is more preferably 600 MPa or less.

The wall thickness of the electric resistance welded steel pipe according to aspects of the present invention is preferably 17 mm or more and 30 mm or less.

The outside diameter of the electric resistance welded steel pipe according to aspects of the present invention is preferably 350 mm or more and 750 mm or less.

EXAMPLES

Details of the present invention are further described with reference to Examples below. Note that the present invention is not limited to Examples below.

Molten steels having the chemical compositions described in Table 1 were prepared and formed into slabs. The slabs were subjected to a hot rolling step, a cooling step, and a coiling step under the conditions described in Table 2. Hereby, hot rolled steel sheets for electric resistance welded steel pipes were prepared.

Subsequent to the coiling step, each of the hot rolled steel sheets was formed into a hollow-cylindrical round steel pipe by roll forming, and the abutting edges of the steel pipe were joined to each other by electric resistance welding. Subsequently, diameter reduction was performed using the rolls arranged to face the upper, lower, left, and right sides of the round steel pipe. Hereby, electric resistance welded steel pipes having the outside diameters (mm) and wall thicknesses (mm) described in Table 2 were prepared.

An electric resistance welded steel pipe having a length of 1800 mm in the axial direction of the steel pipe was taken from each of the electric resistance welded steel pipes and subjected to the measurement of residual stress in the axial direction of the pipe and an axial compression test.

Test specimens were also taken from each of the electric resistance welded steel pipes and subjected to the measurement of dislocation density, the measurement of residual stress, the microstructure observation, the tensile test, the Charpy impact test, and the axial compression test described below. The above test specimens were taken from the base metal zone, which was 90° away from the electric resistance welded zone in the circumferential direction of the pipe.

{Measurement of Dislocation Density}

Dislocation density was determined by electropolishing a cross section of the pipe which was perpendicular to the longitudinal direction to a depth of 100 μm, subsequently performing X-ray diffractometry at the center of the steel sheet in the thickness direction, and performing a calculation on the basis of the results using the modified Williamson-Hall method or the modified Warren-Averbach method (Non-Patent Literatures 1 and 2). CuKα radiation was used as an X-ray source. The tube voltage was set to 45 kV. The tube current was set to 200 mA. The Burgers vector b was $0.248\times10^{-9}$ m, which is the interatomic distance in the slip direction of bcc iron, <111>.

{Measurement of Residual Stress}

The measurement of residual stress was conducted, by X-ray diffraction, in the planes exposed by electropolishing the inner and outer surfaces of the electric resistance welded steel pipe at the longitudinal center of the pipe to a depth of 100 μm. CrKα radiation was used as an X-ray source. The tube voltage was set to 30 kV. The tube current was set to 1.0 mA. The measurement was conducted using a cos α method. The lattice plane that was to be measured was (211).

The residual stress was determined in the axial direction of the pipe. The measurement was conducted at the electric resistance welded zone and positions spaced at intervals of 30 degrees with reference to the electric resistance welded zone in the circumferential direction of the pipe, that is, at 24 positions for each electric resistance welded steel pipe. The maximum compressive residual stress was determined on the basis of the results of measurement at the 24 positions.

{Microstructure Observation}

A test specimen for microstructure observation was prepared by taking a sample such that the observation surface was a cross section of the pipe which was perpendicular to the longitudinal direction of the pipe and was at the sheet-thickness center, polishing the sample, and subsequently performing nital etching. In the microstructure observation, a microstructure present at the sheet-thickness center was observed and an image of the microstructure was taken with an optical microscope (magnification: 1000 times) or a scanning electron microscope (SEM, magnification: 1000 times). The area fractions of bainite and the balance (ferrite, pearlite, martensite, and austenite) were determined on the basis of the optical microscope image and the SEM image. The area fractions of the above microstructure components were each determined by conducting the above observation in five or more fields of view and taking the average of the fractions measured. The area fractions determined by the microstructure observation were considered as the volume fractions of the microstructure components.

Ferrite is the product of diffusion transformation and appears as a nearly recovered microstructure having a low dislocation density. Examples of such ferrite include polygonal ferrite and quasipolygonal ferrite.

Bainite is a multi-phase microstructure including lath ferrite having a high dislocation density and cementite.

Pearlite is a eutectic microstructure (ferrite+cementite) including iron and iron carbide and appears as a lamellar microstructure including linear ferrite and cementite arranged alternately.

Martensite is a lath, low-temperature transformation microstructure having a markedly high dislocation density and appears lighter than ferrite and bainite in a SEM image.

In an optical microscope image and a SEM image, it is difficult to distinguish martensite and austenite from each other. Therefore, the volume fraction of martensite was determined by calculating the area fraction of microstructure identified as martensite or austenite in the SEM image and subtracting the volume fraction of austenite measured by the method described below from the above fraction.

The volume fraction of austenite was measured by X-ray diffraction. A test specimen for microstructure observation was prepared by performing grinding such that a diffraction plane was at the sheet-thickness center and removing a surface processing layer by chemical polishing. In the measurement, Mo-Kα radiation was used. The volume fraction of austenite was calculated on the basis of the integral intensities of the (200), (220), and (311) planes of fcc iron and the (200) and (211) planes of bcc iron.

In the measurement of the above average grain size, first, a grain size distribution histogram (graph with the horizontal axis representing grain size and the vertical axis representing the abundance at the grain size) was calculated using a SEM/EBSD method. Then, the arithmetic average grain size was calculated. Specifically, as for grain size, the misorientations between adjacent crystal grains were measured, and the boundaries between crystal grains having a misorientation of 15° or more were considered as crystal grains (grain boundaries). Then, the equivalent circle diameters of the crystal grains were measured. The average of the equivalent circle diameters was used as an average grain size. This equivalent circle diameter is the diameter of a circle having the same area as a crystal grain that is to be measured.

The measurement was conducted under the following conditions: acceleration voltage: 15 kV, measurement region: 500 μm×500 μm, measurement step size: 0.5 μm. In the grain size analysis, crystal grains having a size of 2.0 μm or less were considered as a measurement noise and excluded from analysis targets. The resulting area fraction was considered equal to the volume fraction.

{Tensile Test}

In the tensile test, a JIS No. 5 tensile test specimen was taken such that the tensile direction of the tensile test specimen was parallel to the longitudinal direction of the pipe. The tensile test was conducted in accordance with the procedures defined in JIS Z 2241. A yield stress YS (MPa) and a tensile strength TS (MPa) were measured. A yield ratio YR (%) defined as (YS/TS)×100 was calculated. Note that the yield stress YS is a flow stress at a nominal strain of 0.5%.

{Charpy Impact Test}

In the Charpy impact test, a V-notch test specimen was taken from the electric resistance welded steel pipe at the sheet-thickness center such that the longitudinal direction of the test specimen was parallel to the circumferential direction of the steel pipe (perpendicular to the longitudinal direction of the steel pipe). The test was conducted at −40° C. in accordance with the procedures defined in JIS Z 2242 to measure an absorbed energy. The number of test specimens taken from each steel pipe was three, and the average of the absorbed energies of the three test specimens was used as the absorbed energy of the electric resistance welded steel pipe.

{Axial Compression Test}

A pressure-resistant plate was attached to both ends of the steel pipe, and an axial compression test was conducted using a large compressive testing apparatus. The strain at which the compressive load reached its peak was considered as a buckling start strain.

Table 3 lists the results.

TABLE 1

| Steel | Chemical composition (mass %) | | | | | | | | | | | | | | | | |
|---|---|---|---|---|---|---|---|---|---|---|---|---|---|---|---|---|---|
| No. | C | Si | Mn | P | S | Al | N | Nb | V | Ti | Cu | Ni | Cr | Mo | Ca | B | Nb + V + Ti |
| A | 0.052 | 0.15 | 1.43 | 0.008 | 0.0007 | 0.026 | 0.0024 | 0.030 | 0.041 | 0.015 | 0.14 | 0.15 | — | — | 0.0044 | — | 0.086 |
| B | 0.197 | 0.04 | 0.66 | 0.012 | 0.0070 | 0.042 | 0.0037 | 0.015 | 0.019 | 0.011 | — | — | 0.13 | 0.14 | 0.0022 | — | 0.045 |
| C | 0.101 | 0.33 | 2.14 | 0.011 | 0.0090 | 0.033 | 0.0034 | 0.024 | 0.020 | 0.018 | — | — | — | — | 0.0036 | — | 0.062 |
| D | 0.142 | 0.24 | 1.13 | 0.003 | 0.0010 | 0.025 | 0.0042 | 0.081 | 0.005 | 10.023 | — | — | — | — | — | 0.0006 | 0.109 |
| E | 0.149 | 0.58 | 1.87 | 0.002 | 0.0006 | 0.030 | 0.0025 | 0.035 | 0.012 | 0.045 | — | — | — | — | 0.0013 | 0.0028 | 0.092 |
| F | 0.088 | 0.12 | 1.55 | 0.006 | 0.0012 | 0.028 | 0.0033 | 0.038 | 0.024 | 0.016 | — | — | — | — | — | — | 0.078 |
| G | 0.092 | 0.22 | 1.52 | 0.001 | 0.0008 | 0.042 | 0.0040 | 0.011 | 0.025 | 0.029 | 0.37 | 0.24 | — | — | 0.0015 | — | 0.065 |

TABLE 1-continued

| Steel | Chemical composition (mass %) | | | | | | | | | | | | | | | | |
|---|---|---|---|---|---|---|---|---|---|---|---|---|---|---|---|---|---|
| No. | C | Si | Mn | P | S | Al | N | Nb | V | Ti | Cu | Ni | Cr | Mo | Ca | B | Nb + V + Ti |
| H | 0.125 | 0.06 | 1.15 | 0.008 | 0.0024 | 0.031 | 0.0026 | 0.023 | 0.003 | 0.017 | — | — | 0.23 | 0.28 | 0.0023 | — | 0.043 |
| I | 0.036 | 0.13 | 1.74 | 0.002 | 0.0005 | 0.045 | 0.0036 | 0.020 | 0.018 | 0.019 | — | — | 0.34 | 0.17 | 0.0025 | — | 0.057 |
| J | 0.530 | 0.06 | 0.56 | 0.015 | 0.0021 | 0.033 | 0.0043 | 0.008 | 0.005 | 0.009 | — | — | — | — | 0.0042 | — | 0.022 |
| K | 0.081 | 0.01 | 1.92 | 0.025 | 0.0009 | 0.024 | 0.0029 | 0.038 | 0.041 | 0.024 | 0.26 | 0.20 | — | — | 0.0036 | — | 0.103 |
| L | 0.047 | 2.10 | 2.85 | 0.004 | 0.0015 | 0.021 | 0.0041 | 0.012 | 0.004 | 0.015 | — | — | — | — | 0.0029 | — | 0.031 |
| M | 0.066 | 0.29 | 0.35 | 0.011 | 0.0030 | 0.039 | 0.0033 | 0.025 | 0.039 | 0.011 | 0.33 | 0.25 | — | — | 0.0017 | — | 0.075 |
| N | 0.052 | 0.03 | 3.13 | 0.018 | 0.0052 | 0.018 | 0.0025 | 0.009 | 0.007 | 0.014 | — | — | — | — | 0.0024 | — | 0.030 |
| O | 0.088 | 0.33 | 1.58 | 0.005 | 0.0041 | 0.040 | 0.0019 | 0.001 | 0.025 | 0.020 | — | — | 0.28 | 0.24 | 0.0030 | — | 0.046 |
| P | 0.045 | 0.12 | 0.73 | 0.006 | 0.0008 | 0.025 | 0.0038 | 0.156 | 0.006 | 0.022 | — | — | — | — | 0.0041 | — | 0.180 |
| Q | 0.093 | 0.11 | 1.24 | 0.008 | 0.0010 | 0.037 | 0.0027 | 0.018 | 0.001 | 0.015 | — | — | 0.19 | 0.20 | 0.0039 | — | 0.033 |
| R | 0.049 | 0.05 | 0.46 | 0.003 | 0.0024 | 0.033 | 0.0036 | 0.005 | 0.154 | 0.009 | — | — | — | — | 0.0022 | — | 0.168 |
| S | 0.067 | 0.28 | 1.05 | 0.019 | 0.0033 | 0.026 | 0.0045 | 0.008 | 0.015 | 0.001 | — | — | — | — | 0.0013 | — | 0.024 |
| T | 0.057 | 0.08 | 0.42 | 0.020 | 0.0015 | 0.029 | 0.0022 | 0.007 | 0.004 | 0.157 | — | — | — | — | 0.0014 | — | 0.163 |
| U | 0.041 | 0.09 | 0.44 | 0.013 | 0.0022 | 0.038 | 0.0019 | 0.003 | 0.002 | 0.004 | — | — | — | — | 0.0028 | — | 0.009 |
| V | 0.041 | 0.09 | 0.44 | 0.013 | 0.0022 | 0.038 | 0.0019 | 0.053 | 0.055 | 0.112 | — | — | — | — | 0.0028 | — | 0.220 |

Constituents other than the above are the balance including Fe and incidental impurities.

TABLE 2

| | | Hot rolling conditions | | | | | Steel pipe dimensions | | Heat treatment | |
|---|---|---|---|---|---|---|---|---|---|---|
| Steel pipe No. | Steel No. | Heating temperature (° C.) | Total rolling reduction ratio at 950° C. or less (%) | Average cooling rate (° C./s) | Cooling stop temperature (° C.) | Coiling temperature (° C.) | Outside diameter D (mm) | Wall thickness t (mm) | Temperature (° C.) | Holding time (s) |
| 1 | A | 1200 | 69 | 31 | 520 | 500 | 508.0 | 23.8 | 600 | 120 |
| 2 | A | 1200 | 71 | 26 | 540 | 515 | 508.0 | 23.8 | 600 | 120 |
| 3 | A | 1200 | 68 | 25 | 580 | 560 | 508.0 | 23.8 | — | — |
| 4 | B | 1250 | 73 | 22 | 620 | 595 | 609.6 | 22.2 | 550 | 900 |
| 5 | B | 1250 | 70 | 34 | 570 | 550 | 406.4 | 22.2 | 450 | 180 |
| 6 | C | 1200 | 67 | 29 | 490 | 470 | 660.4 | 20.6 | 600 | 500 |
| 7 | C | 1250 | 58 | 12 | 610 | 585 | 609.6 | 22.2 | 650 | 60 |
| 8 | D | 1200 | 62 | 14 | 645 | 625 | 508.0 | 22.2 | 630 | 300 |
| 9 | D | 1150 | 64 | 21 | 630 | 610 | 609.6 | 20.6 | 500 | 100 |
| 10 | E | 1150 | 72 | 33 | 440 | 415 | 508.0 | 22.2 | 580 | 500 |
| 11 | F | 1200 | 68 | 30 | 540 | 520 | 406.4 | 20.6 | 620 | 500 |
| 12 | G | 1200 | 66 | 37 | 550 | 530 | 660.4 | 25.4 | 600 | 300 |
| 13 | H | 1150 | 74 | 28 | 570 | 550 | 508.0 | 20.6 | 650 | 150 |
| 14 | I | 1200 | 66 | 35 | 620 | 605 | 406.4 | 23.8 | 550 | 60 |
| 15 | J | 1200 | 69 | 25 | 520 | 505 | 508.0 | 20.6 | 500 | 900 |
| 16 | K | 1200 | 70 | 31 | 640 | 620 | 508.0 | 20.6 | 600 | 100 |
| 17 | L | 1150 | 62 | 18 | 560 | 540 | 508.0 | 23.8 | 600 | 180 |
| 18 | M | 1250 | 65 | 22 | 600 | 580 | 609.6 | 22.2 | 630 | 100 |
| 19 | N | 1150 | 72 | 34 | 540 | 515 | 508.0 | 22.2 | 500 | 720 |
| 20 | O | 1150 | 61 | 37 | 620 | 595 | 660.4 | 23.8 | 630 | 180 |
| 21 | P | 1250 | 69 | 12 | 530 | 510 | 508.0 | 20.6 | 550 | 300 |
| 22 | Q | 1200 | 68 | 16 | 615 | 600 | 508.0 | 22.2 | 580 | 300 |
| 23 | R | 1200 | 67 | 20 | 570 | 550 | 508.0 | 22.2 | 620 | 100 |
| 24 | S | 1150 | 63 | 24 | 595 | 575 | 406.4 | 22.2 | 600 | 90 |
| 25 | T | 1200 | 63 | 23 | 550 | 535 | 660.4 | 25.4 | 600 | 180 |
| 26 | U | 1250 | 64 | 38 | 580 | 560 | 609.6 | 23.8 | 580 | 120 |
| 27 | V | 1250 | 64 | 38 | 540 | 525 | 406.4 | 19.1 | 550 | 300 |

| | | | Steel microstructure (*1) | | | | | | Residual stress in surfaces of steel pipe Maximum | |
|---|---|---|---|---|---|---|---|---|---|---|
| Steel pipe No. | Sizing after heat treatment Diameter reduction (%) | F fraction (%) | B fraction (%) | (F + B) fraction (%) | Balance type | Average grain size (μm) | Dislocation density ($m^{-2}$) | compressive residual stress (MPa) | Remark |
| 1 | 2.5 | 0 | 99 | 99 | M | 4.6 | $1.1 \times 10^{15}$ | 82 | Invention example |
| 2 | 0.41 | 0 | 99 | 99 | M | 4.9 | $9.4 \times 10^{13}$ | 79 | Comparative example |
| 3 | — | 0 | 97 | 97 | M | 5.3 | $7.2 \times 10^{15}$ | 359 | Comparative example |

TABLE 2-continued

| | | | | | | | | | |
|---|---|---|---|---|---|---|---|---|---|
| 4 | 2.8 | 45 | 38 | 83 | P, M | 6.1 | $9.6 \times 10^{14}$ | 95 | Invention example |
| 5 | 4.7 | 37 | 45 | 82 | P, M | 5.8 | $6.5 \times 10^{15}$ | 132 | Comparative example |
| 6 | 1.7 | 13 | 79 | 92 | P, M | 6.4 | $2.4 \times 10^{15}$ | 103 | Invention example |
| 7 | 3.2 | 9 | 88 | 97 | P, M | 9.2 | $5.3 \times 10^{15}$ | 88 | Comparative example |
| 8 | 2.1 | 81 | 0 | 81 | P | 5.1 | $5.2 \times 10^{14}$ | 126 | Invention example |
| 9 | 5.4 | 84 | 7 | 91 | P | 6.2 | $5.7 \times 10^{15}$ | 198 | Comparative example |
| 10 | 3.3 | 42 | 36 | 78 | M, A | 4.7 | $4.4 \times 10^{14}$ | 118 | Invention example |
| 11 | 2.0 | 37 | 46 | 83 | P | 6.8 | $7.7 \times 10^{14}$ | 108 | Invention example |
| 12 | 1.9 | 12 | 86 | 98 | M | 6.2 | $4.8 \times 10^{14}$ | 91 | Invention example |
| 13 | 2.8 | 7 | 92 | 99 | M | 5.9 | $6.1 \times 10^{14}$ | 77 | Invention example |
| 14 | 3.5 | 73 | 26 | 99 | M | 6.7 | $1.5 \times 10^{14}$ | 85 | Comparative example |
| 15 | 1.1 | 21 | 39 | 60 | P, M | 4.8 | $1.3 \times 10^{15}$ | 108 | Comparative example |
| 16 | 3.2 | 48 | 39 | 87 | P, M | 6.5 | $1.8 \times 10^{14}$ | 125 | Comparative example |
| 17 | 2.0 | 16 | 81 | 97 | M | 5.2 | $9.8 \times 10^{14}$ | 95 | Comparative example |
| 18 | 2.4 | 29 | 64 | 93 | P, M | 7.1 | $2.0 \times 10^{14}$ | 110 | Comparative example |
| 19 | 2.5 | 6 | 90 | 96 | M | 4.5 | $8.7 \times 10^{14}$ | 103 | Comparative example |
| 20 | 1.6 | 35 | 54 | 89 | P, M | 7.3 | $1.9 \times 10^{14}$ | 76 | Comparative example |
| 21 | 1.7 | 23 | 75 | 98 | M | 5.4 | $2.2 \times 10^{15}$ | 98 | Comparative example |
| 22 | 2.2 | 30 | 59 | 89 | P, M | 5.8 | $1.5 \times 10^{14}$ | 133 | Comparative example |
| 23 | 2.8 | 17 | 75 | 92 | M | 6.3 | $9.7 \times 10^{14}$ | 114 | Comparative example |
| 24 | 2.1 | 18 | 80 | 98 | P, M | 6.4 | $2.3 \times 10^{14}$ | 112 | Comparative example |
| 25 | 3.3 | 10 | 86 | 96 | M | 5.7 | $2.7 \times 10^{15}$ | 96 | Comparative example |
| 26 | 1.5 | 38 | 60 | 98 | M | 6.1 | $1.8 \times 10^{14}$ | 109 | Comparative example |
| 27 | 3.8 | 34 | 65 | 99 | M | 5.2 | $3.0 \times 10^{15}$ | 124 | Comparative example |

(*1) F: ferrite, B: bainite, P: pearlite, M: martensite, A: austenite

TABLE 3

| | | Mechanical properties | | | | | | |
|---|---|---|---|---|---|---|---|---|
| Steel pipe No. | Steel No. | YS (MPa) | TS (MPa) | YR (%) | Charpy absorbed energy at −40° C. (J) | 40t/D | Buckling start strain (%) | Remark |
| 1 | A | 504 | 615 | 82.0 | 253 | 1.9 | 2.3 | Invention example |
| 2 | A | 579 | 613 | 94.5 | 165 | 1.9 | 1.2 | Comparative example |
| 3 | A | 578 | 610 | 94.8 | 64 | 1.9 | 1.4 | Comparative example |
| 4 | B | 529 | 624 | 84.8 | 239 | 1.5 | 1.8 | Invention example |
| 5 | B | 581 | 619 | 93.9 | 107 | 2.2 | 2.0 | Comparative example |
| 6 | C | 518 | 617 | 84.0 | 179 | 1.2 | 1.6 | Invention example |
| 7 | C | 489 | 592 | 82.6 | 58 | 1.5 | 1.9 | Comparative example |
| 8 | D | 577 | 683 | 84.5 | 198 | 1.7 | 2.2 | Invention example |
| 9 | D | 502 | 546 | 91.9 | 97 | 1.4 | 1.1 | Comparative example |
| 10 | E | 542 | 654 | 82.9 | 201 | 1.7 | 2.1 | Invention example |
| 11 | F | 511 | 622 | 82.2 | 213 | 2.0 | 2.5 | Invention example |
| 12 | G | 493 | 606 | 81.4 | 244 | 1.5 | 1.9 | Invention example |
| 13 | H | 508 | 614 | 82.7 | 219 | 1.6 | 1.7 | Invention example |
| 14 | I | 433 | 505 | 85.7 | 228 | 2.3 | 2.1 | Comparative example |
| 15 | J | 578 | 691 | 83.6 | 26 | 1.6 | 1.8 | Comparative example |
| 16 | K | 446 | 538 | 82.9 | 162 | 1.6 | 1.9 | Comparative example |
| 17 | L | 566 | 652 | 86.8 | 54 | 1.9 | 1.8 | Comparative example |
| 18 | M | 437 | 523 | 83.6 | 61 | 1.5 | 1.7 | Comparative example |
| 19 | N | 577 | 668 | 86.4 | 134 | 1.7 | 1.5 | Comparative example |
| 20 | O | 425 | 511 | 83.2 | 66 | 1.4 | 1.5 | Comparative example |
| 21 | P | 581 | 679 | 85.6 | 50 | 1.6 | 1.3 | Comparative example |
| 22 | Q | 432 | 516 | 83.7 | 137 | 1.7 | 2.0 | Comparative example |
| 23 | R | 567 | 642 | 88.3 | 18 | 1.7 | 1.6 | Comparative example |
| 24 | S | 439 | 527 | 83.3 | 65 | 2.2 | 2.3 | Comparative example |
| 25 | T | 588 | 680 | 86.5 | 23 | 1.5 | 1.1 | Comparative example |
| 26 | U | 440 | 539 | 81.6 | 212 | 1.6 | 1.8 | Comparative example |
| 27 | V | 590 | 672 | 87.8 | 35 | 1.9 | 1.6 | Comparative example |

In Table 3, Steel pipe Nos. 1, 4, 6, 8, 10, and 11 to 13 correspond to Invention Examples, while Steel pipe Nos. 2, 3, 5, 7, 9, and 14 to 27 correspond to Comparative Examples.

The chemical compositions of the base metal zones of the electric resistance welded steel pipes prepared in Invention examples all contained C: 0.040% or more and 0.50% or less, Si: 0.02% or more and 2.0% or less, Mn: 0.40% or more and 3.0% or less, P: 0.10% or less, S: 0.050% or less, Al: 0.005% or more and 0.10% or less, N: 0.010% or less, Nb: 0.002% or more and 0.15% or less, V: 0.002% or more and 0.15% or less, Ti: 0.002% or more and 0.15% or less, and Nb+V+Ti: 0.010% or more and 0.20% or less, with the balance being Fe and incidental impurities. The steel microstructure of the sheet-thickness center of each of the base metal zones included ferrite and bainite such that the total volume fraction of the ferrite and the bainite in the steel microstructure was 70% or more, with the balance being one or more selected from pearlite, martensite, and austenite. The steel microstructure had an average grain size of 7.0 μm or less and a dislocation density of $1.0\times10^{14}$ $m^{-2}$ or more and $6.0\times10^{15}$ $m^{-2}$ or less. The compressive residual stress generated in the inner and outer surfaces of each of the pipes in the axial direction was 150 MPa or less.

As for the mechanical properties of each of the electric resistance welded steel pipes prepared in Invention Examples, the yield stress YS (MPa) was 450 MPa or more, the yield ratio was 85% or less, the Charpy absorbed energy at −40° C. was 70 J or more, and the buckling start strain εc satisfied Formula (1).

$$\varepsilon c \geq 40 \times t/D \quad (1)$$

In Formula (1), D represents outside diameter (mm), and t represents wall thickness (mm).

In contrast, in the steel pipe No. 2 (Steel A) prepared as a comparative example, where the diameter reduction performed in the sizing step subsequent to the heat treatment was low, a sufficient amount of mobile dislocations could not be introduced and, consequently, yield point and yield elongation remained. As a result, yield ratio and buckling start strain did not reach the intended values.

In the steel pipe No. 3 (Steel A) prepared as a comparative example, where the heat treatment was not performed subsequent to pipe-making, dislocation density and compressive residual stress exceeded the respective ranges specified in accordance with aspects of the present invention and, consequently, yield ratio and buckling start strain did not reach the intended values. In addition, dislocation density exceeded the range specified in accordance with aspects of the present invention and, therefore, Charpy absorbed energy at −40° C. did not reach the intended value.

In the steel pipe No. 5 (Steel B) prepared as a comparative example, where the heating temperature in the tempering step was low and the diameter reduction performed in the sizing step subsequent to the heat treatment was high, dislocation density exceeded the range specified in accordance with aspects of the present invention and, as a result, yield ratio and buckling start strain did not reach the intended values.

In the steel pipe No. 7 (Steel C) prepared as a comparative example, where the total rolling reduction ratio at 950° C. or less was low, average grain size exceeded the range specified in accordance with aspects of the present invention and, as a result, the Charpy absorbed energy at −40° C. did not reach the intended value.

In the steel pipe No. 9 (Steel D) prepared as a comparative example, where the diameter reduction performed in the sizing step was high, compressive residual stress exceeded the range specified in accordance with aspects of the present invention and, as a result, yield ratio and buckling start strain did not reach the intended values.

In the steel pipe No. 14 (Steel I) prepared as a comparative example, where the C content was below the range specified in accordance with aspects of the present invention, yield strength, yield ratio, and buckling start strain did not reach the intended values.

In the steel pipe No. 15 (Steel J) prepared as a comparative example, where the C content exceeded the range specified in accordance with aspects of the present invention, the total volume fraction of ferrite and bainite was below the range specified in accordance with aspects of the present invention and, consequently, the Charpy absorbed energy at −40° C. did not reach the intended value.

In the steel pipe No. 16 (Steel K) prepared as a comparative example, where the Si content was below the range specified in accordance with aspects of the present invention, yield strength did not reach the intended value.

In the steel pipe No. 17 (Steel L) prepared as a comparative example, where the Si content exceeded the range specified in accordance with aspects of the present invention, yield ratio and buckling start strain did not reach the intended values. Furthermore, the Charpy absorbed energy at −40° C. did not reach the intended value.

In the steel pipe No. 18 (Steel M) prepared as a comparative example, where the Mn content was below the range specified in accordance with aspects of the present invention, yield strength did not reach the intended value and average grain size exceeded the range specified in accordance with aspects of the present invention. Consequently, the Charpy absorbed energy at −40° C. did not reach the intended value.

In the steel pipe No. 19 (Steel N) prepared as a comparative example, where the Mn content exceeded the range specified in accordance with aspects of the present invention, yield ratio and buckling start strain did not reach the intended values.

In the steel pipe No. 20 (Steel O) prepared as a comparative example, where the Nb content was below the range specified in accordance with aspects of the present invention, yield strength did not reach the intended value and average grain size exceeded the range specified in accordance with aspects of the present invention. Consequently, the Charpy absorbed energy at −40° C. did not reach the intended value.

In the steel pipe No. 21 (Steel P) prepared as a comparative example, where the Nb content exceeded the range specified in accordance with aspects of the present invention, the Charpy absorbed energy at −40° C., yield ratio, and buckling start strain did not reach the intended values.

In the steel pipe No. 22 (Steel Q) prepared as a comparative example, where the V content was below the range specified in accordance with aspects of the present invention, yield strength did not reach the intended value.

In the steel pipe No. 23 (Steel R) prepared as a comparative example, where the V content exceeded the range specified in accordance with aspects of the present invention, the Charpy absorbed energy at −40° C., yield ratio, and buckling start strain did not reach the intended values.

In the steel pipe No. 24 (Steel S) prepared as a comparative example, where the Ti content was below the range specified in accordance with aspects of the present invention, yield strength and the Charpy absorbed energy at −40° C. did not reach the intended values.

In the steel pipe No. 25 (Steel T) prepared as a comparative example, where the Ti content exceeded the range specified in accordance with aspects of the present invention, the Charpy absorbed energy at −40° C., yield ratio, and buckling start strain did not reach the intended values.

In the steel pipe No. 26 (Steel U) prepared as a comparative example, where the (Nb+V+Ti) content was below the range specified in accordance with aspects of the present invention, yield strength did not reach the intended value.

In the steel pipe No. 27 (Steel V) prepared as a comparative example, where the (Nb+V+Ti) content exceeded the range specified in accordance with aspects of the present invention, the Charpy absorbed energy at −40° C., yield ratio, and buckling start strain did not reach the intended values.

REFERENCE SIGNS LIST

1 BASE METAL ZONE
2 HEAT AFFECTED ZONE
3 MOLTEN AND SOLIDIFIED ZONE

The invention claimed is:

1. An electric resistance welded steel pipe comprising a base metal zone and an electric resistance welded zone,
wherein the base metal zone has a chemical composition containing, by mass,
C: 0.040% or more and 0.50% or less,
Si: 0.02% or more and 2.0% or less,
Mn: 0.40% or more and 3.0% or less,
P: 0.10% or less,
S: 0.050% or less,
Al: 0.005% or more and 0.10% or less,
N: 0.010% or less,
Nb: 0.002% or more and 0.15% or less,
V: 0.002% or more and 0.15% or less,
Ti: 0.002% or more and 0.15% or less, and
Nb+V+Ti: 0.010% or more and 0.20% or less,
with the balance being Fe and incidental impurities,
wherein a steel microstructure of a wall-thickness center of the base metal zone includes
ferrite and bainite such that a total volume fraction of the ferrite and the bainite in the steel microstructure is 70% or more, with the balance being one or two or more selected from pearlite, martensite, and austenite,
wherein the steel microstructure has an average grain size of 7.0 m or less and a dislocation density of $1.0\times10^{14}$ $m^{-2}$ or more and $6.0\times10^{15}$ $m^{-2}$ or less, and
wherein a compressive residual stress generated in inner and outer surfaces of the pipe in an axial direction of the pipe is 150 MPa or less.

2. The electric resistance welded steel pipe according to claim 1,
wherein the chemical composition further contains one or two or more selected from, by mass,
Cu: 0.01% or more and 1.0% or less,
Ni: 0.01% or more and 1.0% or less,
Cr: 0.01% or more and 1.0% or less,
Mo: 0.01% or more and 1.0% or less,
Ca: 0.0005% or more and 0.010% or less, and
B: 0.0003% or more and 0.010% or less.

3. The electric resistance welded steel pipe according to claim 1,
wherein a volume fraction of the bainite in the steel microstructure is 90% or more.

4. The electric resistance welded steel pipe according to claim 2,
wherein a volume fraction of the bainite in the steel microstructure is 90% or more.

5. The electric resistance welded steel pipe according to claim 1,
having a wall thickness of 17 mm or more and 30 mm or less.

6. The electric resistance welded steel pipe according to claim 2,
having a wall thickness of 17 mm or more and 30 mm or less.

7. The electric resistance welded steel pipe according to claim 3,
having a wall thickness of 17 mm or more and 30 mm or less.

8. The electric resistance welded steel pipe according to claim 4,
having a wall thickness of 17 mm or more and 30 mm or less.

9. A method for producing the electric resistance welded steel pipe according to claim 1, the method comprising:
a hot rolling step of heating a steel material to a heating temperature of 1100° C. or more and 1300° C. or less and subsequently performing a hot rolling processing such that a total rolling reduction ratio at 950° C. or less is 60% or more;
a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;
a coiling step of performing coiling, subsequent to the cooling step, at 400° C. or more and 650° C. or less to prepare a hot rolled steel sheet;
a pipe-making step of forming the hot rolled steel sheet into a hollow-cylindrical shape by cold roll forming and subsequently performing electric resistance welding to prepare a steel pipe material;
a tempering step of heating the steel pipe material, subsequent to the pipe-making step, at 500° C. or more and 700° C. or less for 10 s or more and 1000 s or less; and
a sizing step of reducing a diameter of the steel pipe material, subsequent to the tempering step, such that a circumference of the steel pipe material reduces by 0.50% or more and 4.0% or less to form an electric resistance welded steel pipe.

10. A method for producing the electric resistance welded steel pipe according to claim 2, the method comprising:
a hot rolling step of heating a steel material to a heating temperature of 1100° C. or more and 1300° C. or less and subsequently performing a hot rolling processing such that a total rolling reduction ratio at 950° C. or less is 60% or more;
a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;
a coiling step of performing coiling, subsequent to the cooling step, at 400° C. or more and 650° C. or less to prepare a hot rolled steel sheet;
a pipe-making step of forming the hot rolled steel sheet into a hollow-cylindrical shape by cold roll forming and subsequently performing electric resistance welding to prepare a steel pipe material;
a tempering step of heating the steel pipe material, subsequent to the pipe-making step, at 500° C. or more and 700° C. or less for 10 s or more and 1000 s or less; and
a sizing step of reducing a diameter of the steel pipe material, subsequent to the tempering step, such that a circumference of the steel pipe material reduces by 0.50% or more and 4.0% or less to form an electric resistance welded steel pipe.

11. A method for producing the electric resistance welded steel pipe according to claim 3, the method comprising:
a hot rolling step of heating a steel material to a heating temperature of 1100° C. or more and 1300° C. or less and subsequently performing a hot rolling processing such that a total rolling reduction ratio at 950° C. or less is 60% or more;
a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

12. A method for producing the electric resistance welded steel pipe according to claim 4, the method comprising:

a hot rolling step of heating a steel material to a heating temperature of 1100° C. or more and 1300° C. or less and subsequently performing a hot rolling processing such that a total rolling reduction ratio at 950° C. or less is 60% or more;

a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

13. A method for producing the electric resistance welded steel pipe according to claim 5, the method comprising:

a hot rolling step of heating a steel material to a heating temperature of 1100° C. or more and 1300° C. or less and subsequently performing a hot rolling processing such that a total rolling reduction ratio at 950° C. or less is 60% or more;

a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

14. A method for producing the electric resistance welded steel pipe according to claim 6, the method comprising:

a hot rolling step of heating a steel material to a heating temperature of 1100° C. or more and 1300° C. or less and subsequently performing a hot rolling processing such that a total rolling reduction ratio at 950° C. or less is 60% or more;

a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

15. A method for producing the electric resistance welded steel pipe according to claim 7, the method comprising:

a hot rolling step of heating a steel material to a heating temperature of 1100° C. or more and 1300° C. or less and subsequently performing a hot rolling processing such that a total rolling reduction ratio at 950° C. or less is 60% or more;

a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

16. A method for producing the electric resistance welded steel pipe according to claim 8, the method comprising:

a hot rolling step of heating a steel material to a heating temperature of 1100° C. or more and 1300° C. or less and subsequently performing a hot rolling processing such that a total rolling reduction ratio at 950° C. or less is 60% or more;

a cooling step of performing cooling, subsequent to the hot rolling step, at an average cooling rate of 10° C./s or more and 40° C./s or less and a cooling stop temperature of 400° C. or more and 650° C. or less, in terms of a temperature of a sheet-thickness center;

a coiling step of performing coiling, subsequent to the cooling step, at 400° C. or more and 650° C. or less to prepare a hot rolled steel sheet;

a pipe-making step of forming the hot rolled steel sheet into a hollow-cylindrical shape by cold roll forming and subsequently performing electric resistance welding to prepare a steel pipe material;

a tempering step of heating the steel pipe material, subsequent to the pipe-making step, at 500° C. or more and 700° C. or less for 10 s or more and 1000 s or less; and a sizing step of reducing a diameter of the steel pipe material, subsequent to the tempering step, such that a circumference of the steel pipe material reduces by 0.50% or more and 4.0% or less to form an electric resistance welded steel pipe.

* * * * *